US006196239B1

(12) United States Patent
Eskey

(10) Patent No.: US 6,196,239 B1
(45) Date of Patent: Mar. 6, 2001

(54) DISHWASHER STATUS INDICATOR

(76) Inventor: Mark W. Eskey, 315 Sussex Ct., Swedesboro, NJ (US) 08085

( * ) Notice: Subject to any disclaimer, the term of this patent is extended or adjusted under 35 U.S.C. 154(b) by 0 days.

(21) Appl. No.: 09/347,379

(22) Filed: Jul. 6, 1999

(51) Int. Cl.[7] ..... A47L 15/42
(52) U.S. Cl. ..... 134/113; 116/216
(58) Field of Search ..... 134/113; 116/216, 116/217, 218; 374/160

(56) References Cited

U.S. PATENT DOCUMENTS

| | | | |
|---|---|---|---|
| D. 317,944 | 7/1991 | George | D20/42 |
| D. 345,829 | 4/1994 | Mancuso et al. | D32/3 |
| 2,965,978 | 12/1960 | Olson | 35/23 |
| 4,129,954 | 12/1978 | Hulteen | 40/607 |
| 4,353,990 | 10/1982 | Manske et al. | 435/287 |
| 4,653,423 | 3/1987 | Schafer | 116/228 |
| 5,092,124 | 3/1992 | White et al. | 60/527 |
| 5,229,753 | 7/1993 | Berg et al. | 340/679 |
| 5,467,545 | 11/1995 | Zillner | 40/597 |
| 5,477,872 | 12/1995 | Berg | 134/52 |
| 5,839,458 * | 11/1998 | Delcarson | 134/113 |

* cited by examiner

*Primary Examiner*—Philip R. Coe
(74) *Attorney, Agent, or Firm*—Norman E. Lehrer

(57) ABSTRACT

An indicator for use with a dishwasher for indicating whether the dishes in the dishwasher are clean or dirty includes a housing having a substantially translucent front wall. A graphic image is formed on the inside surface of the front wall so as to form printed areas and unprinted areas. Lying directly behind the front wall within the housing is a face plate having two different graphics formed thereon. The face plate is slideable relative to the front wall. In one position, graphics on the face plate show through the front wall to indicate that the dishes are dirty. In a second position, the graphics on the face plate show through the front wall to indicate that the dishes are clean. The face plate is releasably held in the dirty position against the force of a spring. Upon sensing an elevated temperature indicating that the dishwasher had been run, the releasable holding mechanism releases allowing the spring to move the face plate into the clean position.

14 Claims, 3 Drawing Sheets

DISHWASHER STATUS INDICATOR

BACKGROUND OF THE INVENTION

The present invention is directed toward a dishwasher status indicator and, more particularly, toward a device which is intended to be left inside of a dishwasher and which gives a visual indication to the user as to whether the dishes are clean or dirty. This reduces the possibility of soiling a clean load of dishes by inadvertently placing dirty dishes into a machine that had been run and also reduces the possibility of inadvertently utilizing dirty dishes or utensils that are in the machine waiting to be cleaned.

Automatic dishwashers have been popular for many years in most homes and in commercial establishments such as restaurants and the like. Dishwashers are used not only to clean soiled dishes but to also sanitize the dishes and tableware. Substantially all dishwashers operate by the use of an electrical or electronic timer which times the various cycles of operation and advances the machine from one cycle to the next. The average automatic dishwasher may take from one-half hour to an hour to complete a full cycle of operation.

Because of the substantial time involved in the operation of an automatic dishwasher, the average user would not normally stand around waiting for the machine to be done so that the same can be immediately unloaded. Rather, the user frequently will go on to other chores or may leave the house for the day intending to empty the machine at a later time upon return. It is not uncommon, however, for the user to forget that he or she had run the dishwasher or for another family member or co-worker to not know whether the machine had been run and, therefore, whether the dishes and utensils therein are clean.

Visual inspection of the contents of a dishwasher is not always satisfactory. While the dishes may appear to be clean, this does not guarantee that the machine had been run and that all of the dishes and utensils have been sanitized. As a result, the user may unknowingly remove and utilize a dirty dish or utensil or may place a dirty dish into an unknown clean machine thereby soiling the clean dishes which would necessitate running the entire load a second time.

Devices have been previously proposed for indicating to a user whether the dishes in a dishwasher are clean or dirty. U.S. Pat. No. 4,129,954 to Hulteen, for example, is directed toward a sign which bears alternate messages such as DIRTY DISHES and CLEAN DISHES and which is affixed to a support rod removably attached to the rack of the dishwasher. The user must remember, however, to manually move the sign between the two positions. If the user forgets to move the sign from dirty dishes to clean dishes, it will always be in the dirty dishes mode even after the machine has been run. Similarly, the user may forget to move the sign into the dirty dishes mode thereby erroneously suggesting that the dishes are clean.

In U.S. Pat. No. 5,477,872 to Berg, a device is proposed which is intended to provide an automatic indication of whether the dishes within an automatic dishwasher are dirty or clean. The device includes a container or compartment that catches a portion of the liquid utilized by the dishwasher and further includes a release mechanism for releasing the liquid when dishes or other articles are removed from the dishwasher. Thus, if the device contains liquid, this is an indication that the dishes or other articles in the dishwasher are clean. If the device is empty, it indicates that the articles are dirty. However, it may not always be readily apparent to a user as to whether there is liquid remaining in the device.

Furthermore, there is the possibility that the liquid could be inadvertently released, thereby giving a false indication that the dishes are dirty.

A more complex indicator is suggested in U.S. Pat. No. 5,229,753 to Berg et al. This patent discloses a warning device which includes a sensor and which provides a visual and/or audible alarm to indicate that the dishes within a dishwasher are clean or dirty. The system described in this patent includes a detector or sensor for sensing whether the racks within the dishwasher hold articles and further includes logic circuits responsive to the detector which indicate that the articles have been cleaned when a predetermined operating state, for example, the end of the wash cycle, of the machine is detected. The electronically-controlled system described in this patent is obviously somewhat complex and is certainly more than may be necessary. Furthermore, the complexity of the described invention would certainly increase the cost of the same.

SUMMARY OF THE INVENTION

The present invention is designed to overcome the deficiencies of the prior art described above and is intended to provide a simple, inexpensive and easy to use device. According to the invention, an indicator for use with a dishwasher for indicating whether the dishes in the dishwasher are clean or dirty includes a housing and an integral strap for suspending the device from a shelf within the dishwasher. The housing includes a front wall that is substantially translucent. A graphic image is formed on the inside surface of the front wall so as to form printed areas and unprinted areas. Lying directly behind the front wall and within the housing is a face plate having two different graphics formed thereon. The face plate is slideable or otherwise moveable relative to the front wall between two different predetermined positions. In one position, a portion of the graphics on the face plate show through the front wall to indicate that the dishes are dirty. In a second position, a different portion of the graphics on the face plate show through the front wall to indicate that the dishes are clean. The face plate is releasably held in the dirty position against the force of a spring. Upon sensing an elevated temperature indicating that the dishwasher has been run, the releasable holding mechanism releases allowing the spring to move the face plate into the clean position.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities.

DETAILED DESCRIPTION OF THE PREFERRED EMBODIMENT

Figure 1:
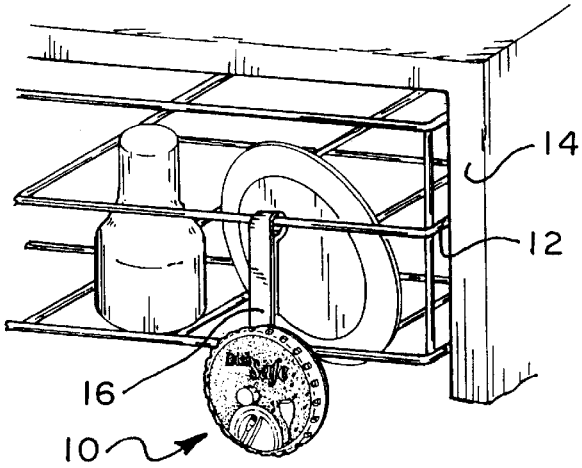
FIG. 1 is a front perspective view showing the dishwasher status indicator of the present invention suspended from the dish rack of a dishwasher.
Figure 2:
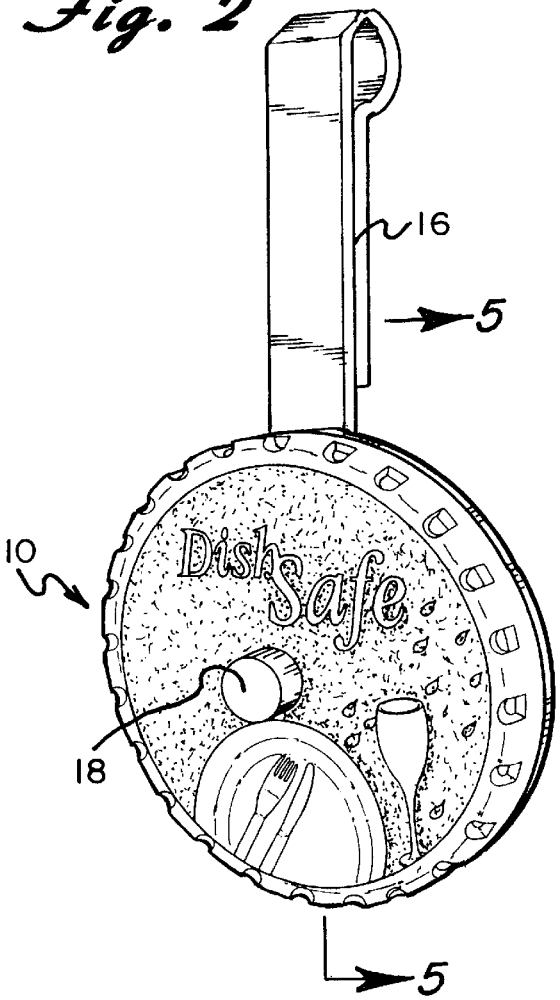
FIG. 2 is an enlarged perspective view of the dishwasher status indicator shown in FIG. 1 and indicating that the dishes are clean.
Figure 3:
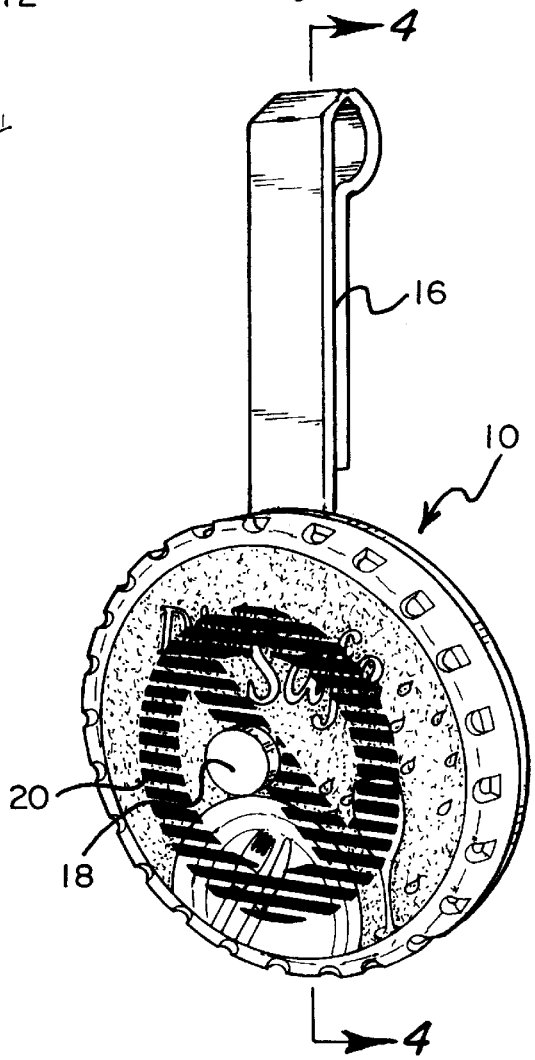
FIG. 3 is a perspective view similar to FIG. 2 but indicating that the dishes are dirty.
Figure 6:
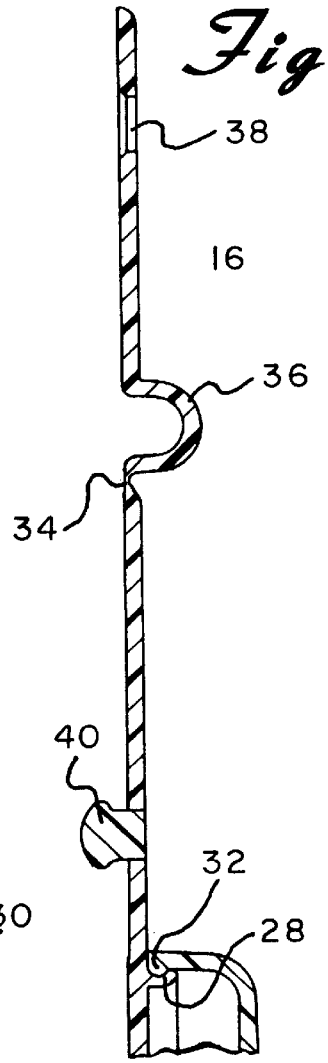
FIG. 6 is a cross-sectional view illustrating the attachment strap of the invention.

Referring now to the drawings in detail wherein like reference numerals have been used throughout the various figures to designate like elements, there is shown in FIGS. 1, 2 and 3, a dishwasher status indicator constructed in accordance with the principles of the present invention and designated generally as 10. The indicator 10 is shown in FIG. 1 suspended from a rack 12 of a dishwasher 14 through the use of an integrally form strap 16, the details of which will be described more fully hereinafter with reference to FIGS. 4, 5 and 6.

The dishwasher status indicator 10 is intended to provide a visual indication to the user as to whether the dishes within the dishwasher 14 are clean or dirty. FIG. 2 illustrates the indicator 10 visually indicating that the dishes are dirty. As can be seen in FIG. 2, the entire picture of the tableware and the words DISH SAFE are clearly visible. Furthermore, the button 18 at the middle of the indicator 10 is shown as extending outwardly from the front face thereof. The appearance of the face of the indicator 10 as shown in FIG. 2 with the button 18 extending outwardly would be the normal appearance of the device after the dishwasher 14 has run through an entire cycle with the indicator 10 therein.

FIG. 3 illustrates the dishwasher status indicator 10 in a first or initial condition intended to indicate that the dishes within the dishwasher are dirty. As can be seen, the international negative symbol 20 appears on the face of the indicator 10 partially obscuring the words DISH SAFE and the graphics of the tableware shown thereon. FIG. 3 also shows the button 18 in its depressed or inward position. In the manner to be described hereinafter, when it is desired to utilize the dishwasher status indicator 10, the button 18 is manually depressed. This causes the international negative symbol to appear on the face thereof. As the dishwasher 14 is operating and the temperature therein increases during, for example, the drying cycle, the button 18 automatically moves outwardly, the international negative symbol 20 disappears and the face of the dishwasher status indicator 10 appears as it does in FIG. 2.

Figure 4:
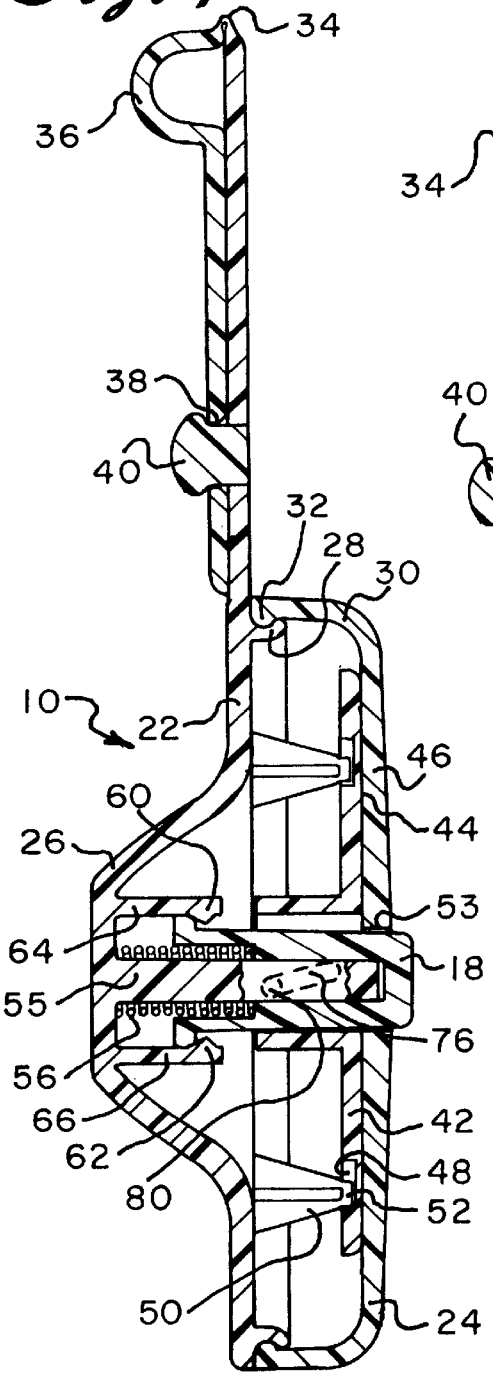
FIG. 4 is a cross-sectional view taken through the line 4—4 of FIG. 3.
Figure 5:
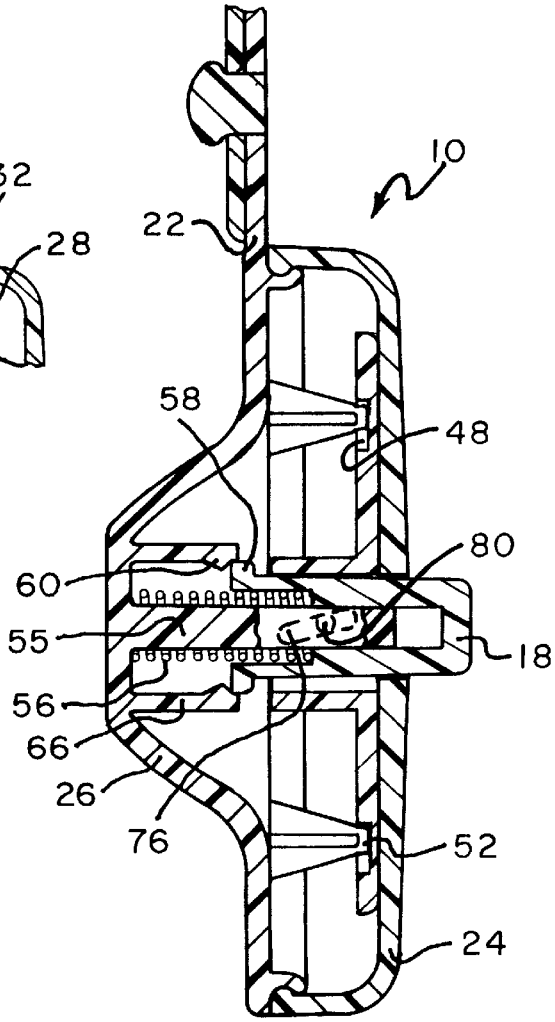
FIG. 5 is a partial cross-sectional view taken through the line 5—5 of FIG. 2.

As shown most clearly in FIGS. 4 and 5, the dishwasher status indicator 10 is comprised essentially of a housing 22 which includes a front cover member 24 and a back or main body portion 26. Extending forwardly from the front surface of the back portion 26 is a peripheral wall forming a snap ring 28. The peripheral side wall 30 of the front or cover includes an inwardly extending bead 32 which snaps over the snap ring 28 in order to form the housing 22 as shown in FIGS. 4 and 5. Preferably substantially all of the component parts of the dishwasher status indicator 10 are formed of a molded plastic material thereby allowing the cover 24 to easily snap onto the back portion 26.

Extending upwardly from the top of the back portion 26 is the strap or handle 16 which is preferably integrally molded therewith. The strap 16 is pre-formed with a living hinge 34, a U-shaped recess 36, an aperture 36 and a projecting snap 40. In order to use the strap 16 to support the dishwasher status indicator 10 onto the rack 12 of a dishwasher, the upper portion of the strap 16 is bent or folded downwardly utilizing the living hinge 34 after the same is placed around the rack 12 so that the wire of the rack is within the recess 36. The aperture 38 then snaps over the projecting snap 40 to close the strap as shown in FIG. 4. The indicator 10 can be released by simply reversing this procedure.

Located within the housing 22 of indicator 10 is a face plate 42 which has a substantially planar front face or surface 44. The face plate 42 lies immediately behind the front face 46 and is substantially in contact with rear surface thereof as shown in FIGS. 4 and 5.

The face plate 42 is mounted for limited sliding movement relative to the front face 46. As shown most clearly in FIG. 8, the rear surface of the face plate 42 has a plurality of elongated recesses 48 formed therein. Preferably, one recess is formed in each corner. Extending forwardly from the back or main body portion 26 of the housing 22 are four guideposts 50, the forwardmost tips 52 of which are intended to lie within the four recesses 48. As a result of this arrangement, the face plate is slideably moveable between a first position as shown in FIG. 4 where it is slightly upward with respect to the front face 46 and a second position as shown in FIG. 5 where the face plate 42 is slightly downwardly with respect to the face plate 46. Although rectilinear sliding movement is presently preferred, it should be readily apparent that a similar result could be accomplished by a slight rotational sliding motion of the face plate.

Movement of the face plate 42 is effectuated through the use of the button 18. As shown most clearly in FIGS. 4 and 5, button 18 includes a hollow main body portion of substantially circular cross section which extends through the circular opening 53 in the front face 46. The opening 54 within the button 18 (see FIG. 8) allows the same to be guided for axial movement on the post 55 that extends forwardly from the back portion 26 toward the interior of the housing 22. A compression spring 56 surrounding the post 55 biases the button 18 outwardly or to the right as viewed in FIGS. 4 and 5.

Although the button 18 is normally biased outwardly into the position shown in FIG. 5, it can be temporarily held in the inward position as shown in FIG. 4. In order to accomplish this, the lower most end of the button 18 includes a radially extended flange 58. The flange 58 cooperates with the projections 60 and 62 formed on the tabs 64 and 66 that extend forwardly from the inside surface of the back portion 26.

As shown best in FIGS. 4 and 5, the projections 60 and 62 have tapered leading and following edges. As a result, if the button 18 is in the outwardly or extended position as shown in FIG. 5, it can be manually pushed inwardly by simply depressing the button. As the button moves inwardly, the flange 58 pushes on the projections 60 causing the tabs 64 and 66 to flex away from each other until the flange 58 clears the projections and is in the position shown in FIG. 4.

The force of the spring 56 and the dimensions of the tabs 64 and flange 58 as well as the materials from which they are made are selected so that, at ambient temperature, the button 18 will remain in the inward position as shown in FIG. 4 when it is manually moved into this position. However, as the temperature rises, the plastic from which the tabs 64 and 66 are made will soften slightly allowing them to move away from each other as the button 18 is moved outwardly by the force of the spring 56. That is, the flange 58 on the button 18 cams the tabs 64 and 66 outwardly as the flange 58 engages the projections 60 and 62 until the flange 58 passes the projections and moves into the position shown in FIG. 5.

The elevated temperature that causes the button 18 to automatically move outwardly may be caused, for example, by hot water from the dishwasher contacting the tabs 64 and 66 or by the heat of a drying cycle. To this end, the front cover 24 is preferably provided with a plurality of openings 68 in the peripheral wall 30 thereof as shown most clearly in FIG. 7. This allows water from the dishwasher and steam or heat to more easily enter the interior of the housing 22 and to come into contact with the tabs 64 and 66 to temporarily soften them.

Figure 9:
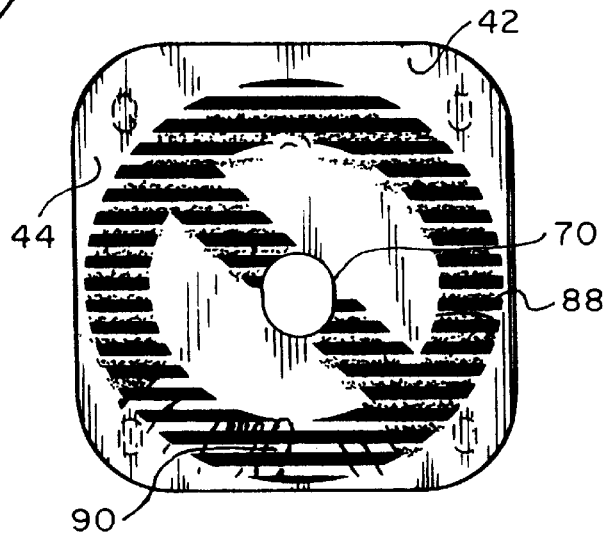
FIG. 9 is a front elevational view of the face plate.
Figure 8:
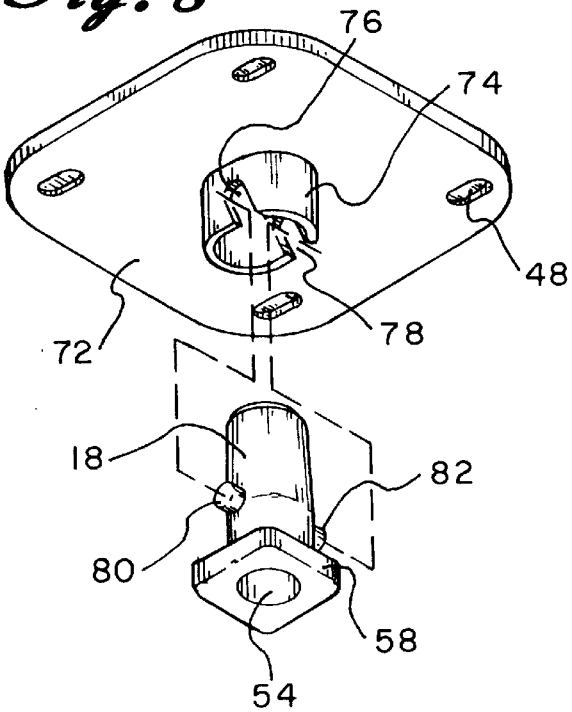
FIG. 8 is an exploded view showing the manner in which a face plate within the indicator is mounted for sliding movement.

As shown most clearly in FIGS. 8 and 9, the face plate 42 includes an elongated opening or aperture 70 at the center thereof. The aperture 70 is only slightly wider than the diameter of the main body portion of the button 18 but is elongated in the vertical direction so as to allow for limited movement of the face plate 42 up and down relative to the button 18. Extending out from the rear surface 72 of the face plate 42 is a substantially tubularly shaped boss member 74.

Angled slotted openings 76 and 78 are formed on either side of the boss 74. These slotted openings 76 and 78 are adapted to engage the sidewardly extending pins 80 and 82 mounted on the button 18. As a result, when the button 18 is moved inwardly or outwardly, the slotted openings 76 and 78 function as cams with the pins 80 and 82 functioning as cam followers. Thus, movement of the button 18 inwardly causes the face plate 42 to move upwardly as shown in FIG. 4. Similarly, outward movement of the button 18 causes the face plate to move downwardly as shown in FIG. 5.

Figure 7:
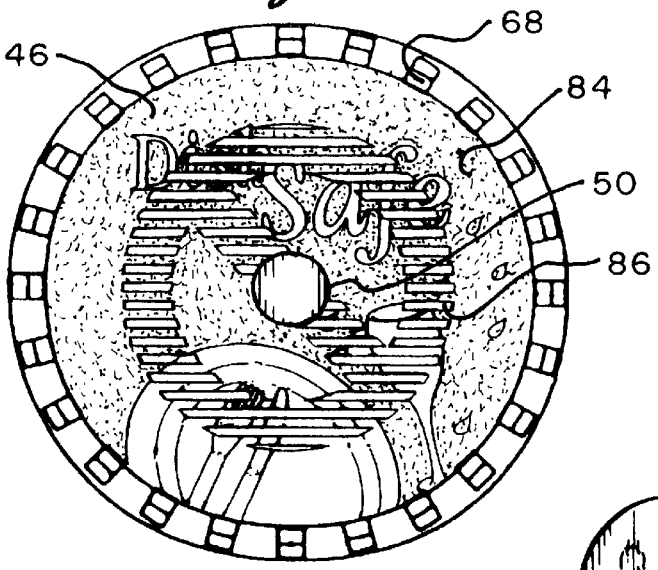
FIG. 7 is a front elevational view showing the details of the front face of the dishwasher status indicator of the invention.

The front face of the cover member 24 is preferably transparent or substantially translucent. Printed or otherwise formed on the inside surface thereof so as to be visible from the front is a graphic image 84 substantially as shown in FIG. 7. The graphic image formed on the inner surface of the front face shows most of the letters forming the words DISH SAFE and most of the picture of the dinnerware and background. However, a number of spaces such as shown at 86 are unprinted so that these areas remain transparent or translucent. In the preferred embodiment as shown in FIG. 7, these unprinted areas 86 together form the outline of the international negative symbol.

The face plate 42 has first and second graphics printed or otherwise formed on the front face or surface 44 thereof. As shown in FIG. 9, the first graphics 88 are comprised of a plurality of dark lines which are essentially complimentary to the transparent openings 86 in the front face 46. The second set of graphics 90 formed on the front surface 44 of the face plate 42 are the complimentary missing portions of the words DISH and SAFE and the tableware and background from the graphics 84 on the front face.

Because the face plate 42 lies directly behind the front face 46, the graphics on the face plate 42 will show through the transparent or translucent portions 86 of the front face 46. It should be readily apparent, therefore, that when the face plate 42 is in its lowermost position as shown in FIG. 5, the solid lines 88 forming the international negative symbol show through the opening 86 in the face plate and appear from the front thereof as shown in FIG. 3. Similarly, when the face plate is in its upward position, the missing portions 90 of the graphics 84 on the front face 46 are in alignment with the opening 86 and showed through so as to have the appearance shown in FIG. 2.

The present invention may be embodied in other specific forms without departing from the spirit or essential attributes thereof and accordingly, reference should be made to the appended claims rather than to the foregoing specification as indicating the scope of the invention.

I claim:

1. An indicator for indicating whether the dishes in a dishwasher are clean or dirty comprising:

a housing including a front face, said front face being substantially translucent and having a graphic image formed thereon, so as to form printed areas and unprinted areas;

a face plate within said housing and lying immediately behind said front face, said face plate having first and second graphics formed thereon;

said face plate being moveable between a first position wherein at least a portion of said first graphics shows through said unprinted areas of said front face and a second position wherein at least a portion of said second graphics shows through said unprinted areas of said front face, and means for automatically moving said face plate from said first position to said second position when said indicator is exposed to an elevated temperature thereby indicating that the dishwasher has been run.

2. The indicator as claimed in claim 1 further including means for manually moving said face plate from said second position to said first position.

3. The indicator as claimed in claim 2 wherein said means for automatically moving includes spring means.

4. The indicator as claimed in claim 3 further including means for releasably holding said face plate in said first position against the force of said spring means.

5. The indicator as claimed in claim 4 wherein said means for releasably holding includes plastic detent means.

6. The indicator as claimed in claim 2 wherein said face plate slides relative to said front face.

7. The indicator as claimed in claim 6 wherein said means for manually moving includes a button accessible from the exterior of said indicator housing.

8. The indicator as claimed in claim 7 wherein said button automatically moves when said face plate automatically moves from said first position to said second position.

9. The indicator as claimed in claim 8 wherein inward movement of said button causes said face plate to move from said second position to said first position.

10. The indicator as claimed in claim 9 wherein said button and said face plate include a cam and cam follower for effectuating movement of said face plate in response to movement of said button.

11. The indicator as claimed in claim 10 further including spring means normally biasing said button outwardly.

12. The indicator as claimed in claim 11 further including means for releasably holding said bufton in an inward position against the force of said spring means.

13. The indicator as claimed in claim 12 wherein said holding means includes plastic detent means.

14. The indicator as claimed in claim 6 further including means within said housing for guiding the sliding movement of said face plate.

* * * * *